US006718778B2

(12) United States Patent
Lawrence

(10) Patent No.: US 6,718,778 B2
(45) Date of Patent: Apr. 13, 2004

(54) DEFROST CONTROL METHOD AND APPARATUS

(75) Inventor: John Michael Walmsley Lawrence, Newbury (GB)

(73) Assignee: JTL Systems Limited, Berkshire (GB)

( * ) Notice: Subject to any disclaimer, the term of this patent is extended or adjusted under 35 U.S.C. 154(b) by 24 days.

(21) Appl. No.: 10/053,165

(22) Filed: Jan. 15, 2002

(65) Prior Publication Data

US 2002/0148240 A1 Oct. 17, 2002

(30) Foreign Application Priority Data

Jan. 16, 2001 (GB) ..... 0101324

(51) Int. Cl.[7] ..... F25D 21/06
(52) U.S. Cl. ..... 62/156; 62/80
(58) Field of Search ..... 62/156, 155, 151, 62/80, 81, 82, 152, 153, 154, 128, 131, 234

(56) References Cited

U.S. PATENT DOCUMENTS 4,993,233 A 2/1991 Borton et al.
5,046,324 A * 9/1991 Otoh et al. ..... 62/156 X
5,379,608 A 1/1995 Ishimaru et al.
5,528,908 A * 6/1996 Bahel et al. ..... 62/156 X
5,727,395 A * 3/1998 Guo et al. ..... 62/155 X
5,813,242 A * 9/1998 Lawrence et al. ..... 62/156 X
6,138,464 A 10/2000 Derosier et al.
6,205,800 B1 * 3/2001 Topper et al. ..... 62/128 X

FOREIGN PATENT DOCUMENTS

| | | |
|---|---|---|
| EP | 0501387 | 2/1992 |
| EP | 0816783 | 1/1998 |
| EP | 0893663 | 1/1999 |
| FR | 2674010 | 9/1992 |
| GB | 2302725 | 1/1997 |
| GB | 2348947 | 10/2000 |

* cited by examiner

*Primary Examiner*—Harry B. Tanner
(74) *Attorney, Agent, or Firm*—Andrus, Sceales, Starke & Sawall, LLP

(57) ABSTRACT

A defrost control system detects the variation in flow rate of refrigerant through an evaporator 8 while the flow is regulated to achieve a desired level of superheat at the outlet of the evaporator 8. When the flow rate becomes unstable, defrosting of the evaporator 8 is triggered.

29 Claims, 6 Drawing Sheets

DEFROST CONTROL METHOD AND APPARATUS

CROSS-REFERENCE TO RELATED APPLICATIONS

This application claims priority to Great Britain application No. 0101324.2 filed Jan. 18, 2001.

The present invention relates to a method and apparatus for controlling defrosting of an evaporator in a heat transfer system, particularly but not exclusively in a refrigeration system in which there is a forced airflow over the evaporator.

FIG. 1 shows in cross-section a refrigerated display cabinet 2, which is one example of such a refrigeration system. The cabinet 2 has a number of shelves for displaying chilled food or drinks. The cabinet 2 is open at the front (to the left in FIG. 1) to allow shoppers easy access to the contents of the shelves 4. The contents are cooled by air blown by a fan 6 over an evaporator 8 of the refrigeration system, which cools the air. As shown by the arrows in FIG. 1, the air leaves the evaporator 8, is forced up a duct 10 and escapes through small vents 12 so that some of the air flows over the contents of the shelves 4.

Most of the air passes through an end aperture 14 at the top of the cabinet 2 and falls as a curtain of cold air down the open front of the cabinet 2 and into an inlet 16, to be recirculated over the evaporator 8. The air curtain hinders the warm ambient air from entering the cabinet.

However, some of the ambient air is drawn into the inlet 16. The ambient air includes water vapour which condenses and freezes on the evaporator 8 to form frost. The frost impedes the passage of air over the evaporator 8 and reduces the efficiency of heat exchange between the evaporator 8 and the air. If the frost is allowed to build up, the rate of airflow will be reduced sufficiently to prevent the air curtain from forming and the internal temperature of the cabinet will rise. Furthermore, the efficiency of the refrigeration system will be reduced, leading to higher running costs.

For these reasons, it is necessary to defrost the evaporator 8 in such refrigeration systems every few hours. There are different conventional methods by which this can be done. In the "air over" or "off cycle" method, the refrigeration is stopped and the evaporator 8 is defrosted by air at ambient temperature passing over it. In the electric defrost method, electric heating elements are provided around the evaporator 8. During a defrost cycle, the flow of refrigerant through the evaporator 8 is stopped and the electric heating elements are switched on, thereby melting the frost; the fan 6 may be switched off.

In the gas defrost method, gas is passed through the evaporator so as to warm it and melt the frost. The gas may be directed from the outlet of the compressor of the refrigeration system through the evaporator, so that the evaporator 8 acts temporarily as a condenser and the refrigeration cycle acts in reverse to release heat from the evaporator 8. This is known as the "hot gas" method.

Alternatively, the gas may be taken from the top of the receiver of the refrigeration system, in which the refrigerant is stored before passing through the expansion valve. This is known as the "cool gas" method, since the refrigerant has passed through the condenser and is cool.

During a defrost, the air temperature inside the cabinet 2 rises above the normal storage temperature, and the contents are subject to "temperature shock". The effect of this temperature shock is to reduce the shelf life of perishable goods. Moreover, the defrost cycle consumes a significant amount of energy, typically around 10% of the total energy used in refrigeration.

Therefore defrost cycles should not occur too frequently, but neither should they occur so infrequently that the refrigeration efficiency of the cabinet 2 is impaired.

In one conventional method of defrost control, a defrost is initiated periodically at intervals sufficiently short to prevent the evaporator 8 from frosting up completely and thereby blocking the flow of air, even at the maximum absolute humidity for which the cabinet 2 is designed. This interval is typically between 6 and 8 hours. However, when the absolute humidity is less than its maximum, defrosts occur more frequently than required.

It is therefore desirable to initiate a defrost "on demand", that is to say only when it is needed.

The document U.S. Pat. No. 5,046,324 discloses a defrost control method in which defrosting is initiated periodically, but a defrost operation is omitted when the total proportion of time spent operating the refrigeration cycle during the last refrigeration period is less than a predetermined value.

The present applicant's earlier patent publications U.S. Pat. Nos. 5,813,242, GB-A-2314915 and EP-A-816783 disclose a defrost control method and apparatus in which a defrost is initiated in response to the detected superheat at the outlet of an evaporator. In a disclosed example, a controller controls the flow of refrigerant through the evaporator so as to keep the temperature of the thermal load constant. However, if the detected superheat at the outlet of the evaporator is too low, the controller enters an override state so that the flow of refrigerant is reduced, thereby raising the superheat. If the period spent in the override condition exceeds a predetermined level, a defrost is initiated.

The present applicant's patent publication no. GB 2348947 discloses a defrost control method and apparatus in which the flow rate through an evaporator is regulated to maintain a desired level of superheat at the outlet. An initial flow rate is measured immediately after a defrost. As the evaporator frosts up, the flow rate falls as the rate of heat transfer into the evaporator falls. When the flow rate has fallen to a predetermined fraction of the initial flow rate, defrosting of the evaporator is triggered.

According to one aspect of the present invention, there is provided a method for controlling defrosting of an evaporator in a heat transfer system, including controlling the flow rate of refrigerant through the evaporator so as to maintain the superheat of refrigerant at or about an outlet of the evaporator substantially constant, and initiating defrosting of the evaporator in response to the fluctuation of the flow rate through the evaporator satisfying a predetermined criterion which indicates that the flow has become unstable.

The flow rate may be controlled automatically by a thermostatic expansion valve. Alternatively, the level of superheat is detected by a sensor and an electronically controlled expansion valve is controlled to keep the superheat at a predetermined level.

The flow rate may be sensed by a flow rate sensor. Alternatively, the flow rate is derived from the degree or period of opening of the expansion valve. Alternatively, the fluctuation in the superheat at the outlet of the evaporator may be measured. An approximate measure of the superheat may be used, derived from the difference between the temperature at the outlet and at a point upstream of the outlet within the evaporator.

Preferably, the flow of refrigerant through the evaporator is switched on and off in response to the sensed temperature of a thermal load rising above a predetermined maximum temperature and falling below a predetermined minimum temperature respectively. The fluctuation of the flow rates is detected only during the period in which the flow is switched on.

The present invention also encompasses apparatus and/or software arranged to carry out the above method.

The fluctuation of the flow rates has been found to give more reliable indication of the degree of frosting of an evaporator than the prior art methods. Moreover, the algorithm based on fluctuation of flow rates is relatively simple to set up and operate, and can be added to an otherwise conventional control apparatus. Measurement of the fluctuation in superheat is particularly advantageous as there is no need to install a flow meter; instead, sensors already required for flow regulation may be used, or only additional temperature sensors need be installed.

Specific embodiments of the present invention will now be described with reference to the accompanying drawings in which.

EMBODIMENTS OF THE INVENTION

Figure 1:
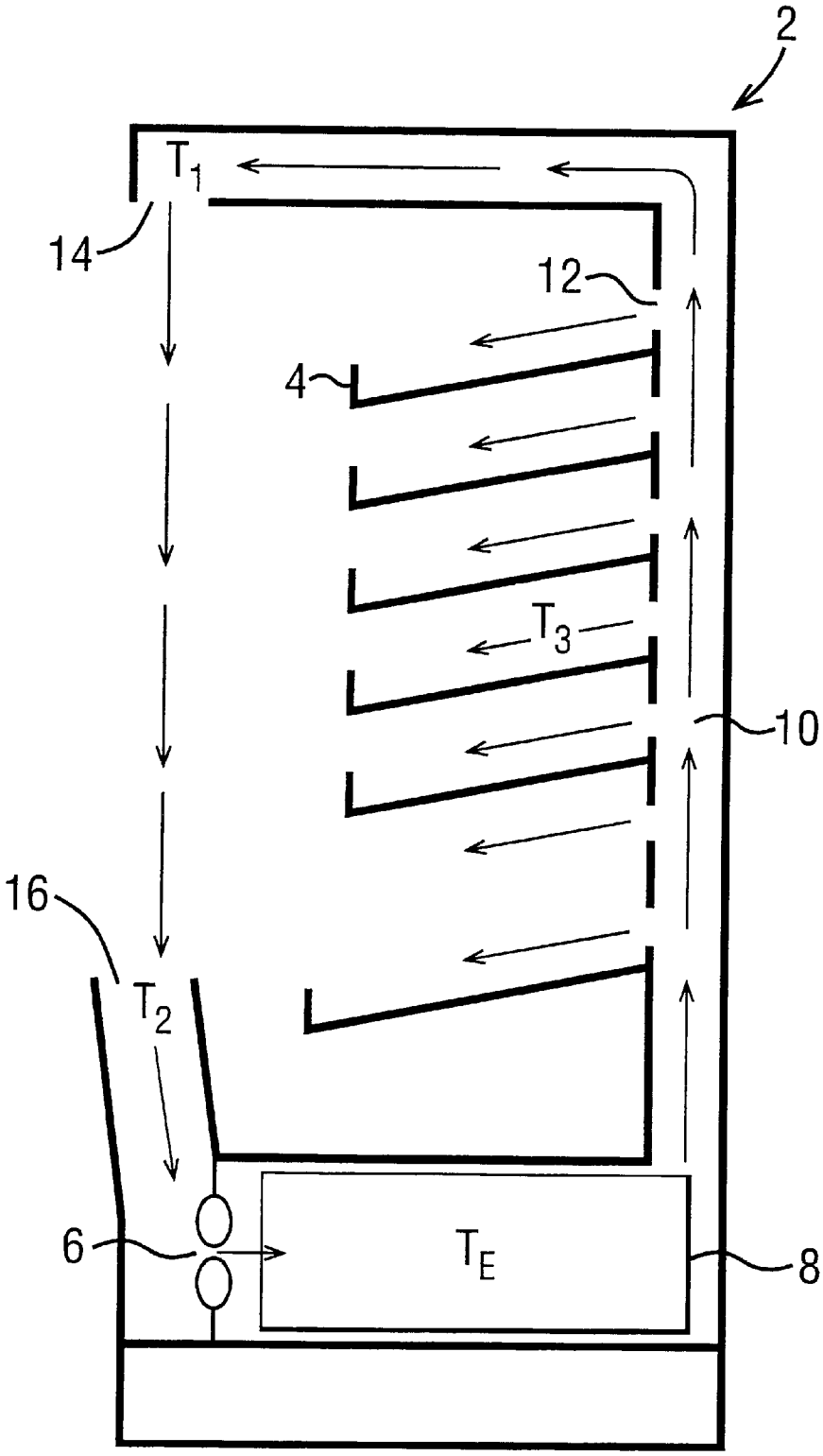
FIG. 1 is a cross-sectional diagram of a refrigerated display cabinet.
Figure 2:
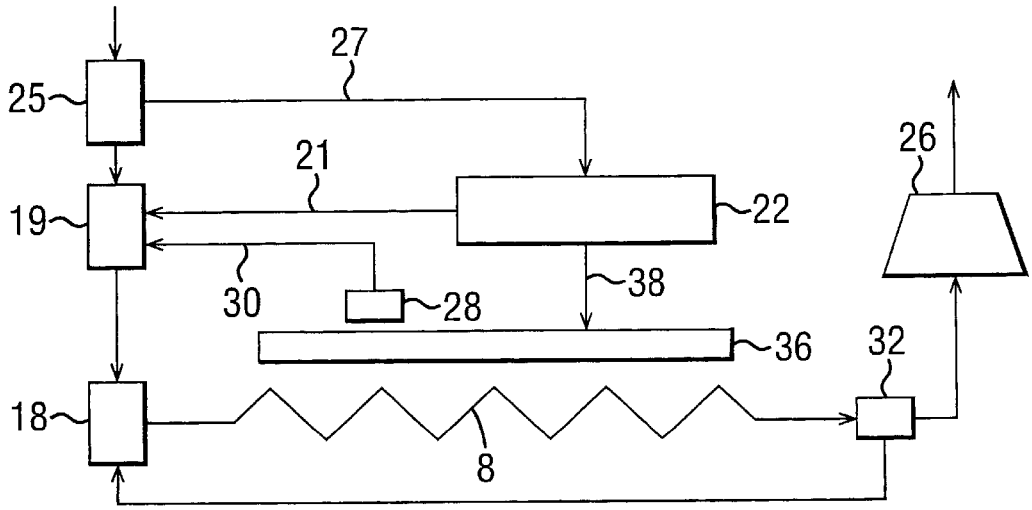
FIG. 2 is a schematic diagram of control apparatus for a refrigeration system in a first embodiment of the present invention.
Figure 3:
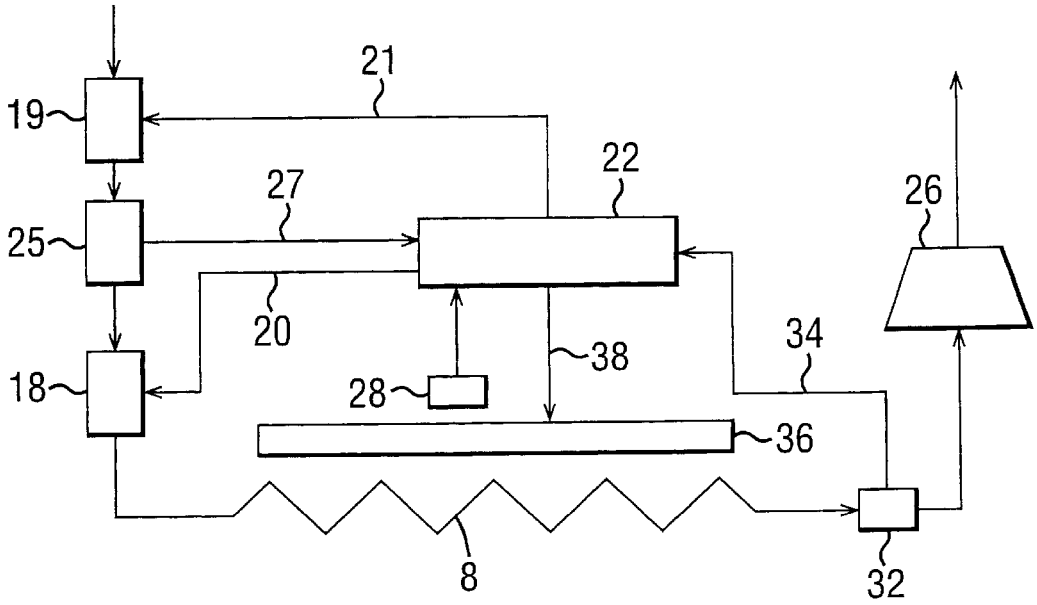
FIG. 3 is a schematic diagram of control apparatus for a refrigeration system in a second embodiment of the present invention.
Figure 4:
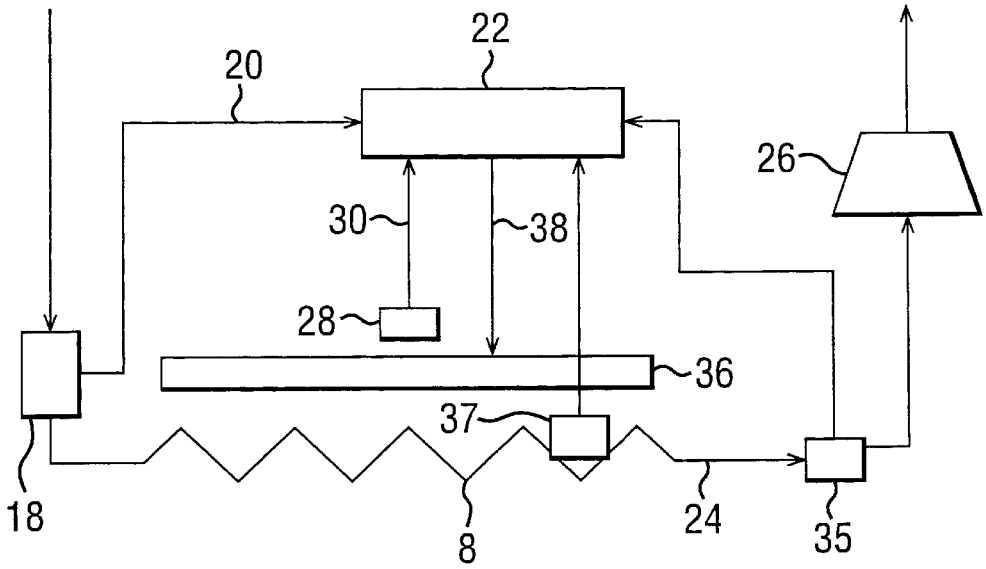
FIG. 4 is a schematic diagram of control apparatus for a refrigeration system in a third embodiment of the present invention.

Specific embodiments of the present invention will now be described with reference to FIGS. 1 to 7. FIGS. 2 to 4 show part of a refrigeration system with control apparatus according to first, second and third embodiments of the invention respectively.

In each embodiment, an expansion valve 18 admits refrigerant at high pressure into the evaporator 8 at low pressure. As the refrigerant passes at low pressure through the evaporator 8, it evaporates and absorbs heat from the air surrounding the evaporator 8 as the latent heat of evaporation. The evaporated refrigerant passes through an outlet 24 of the evaporator 8 and is returned through a suction pipe to a compressor 26 which compresses the refrigerant to high pressure and outputs it to the condenser (not shown), where the refrigerant condenses and releases the latent heat.

In the first embodiment, the expansion valve 18 is a thermostatic expansion valve (TEV) in which the degree of opening of the valve is automatically regulated by a pressure difference. In the second embodiment, the expansion valve 18 is an electronically controlled expansion valve in which the degree of opening of the expansion valve 18 is variable under electronic control. In the third embodiment, the expansion valve 18 is an electronically controlled pulsed expansion valve which has only two states: fully open and closed. The flow rate through the pulsed expansion valve 18 is determined by the duty ratio between the open and closed states.

Superheat Control

The superheat at the outlet 24 is the temperature difference by which the temperature of the refrigerant exceeds the boiling point of the refrigerant at the outlet pressure. If the superheat is zero, the refrigerant is at or below boiling point and there will be liquid refrigerant present at the outlet 24. It is important to prevent liquid refrigerant from entering and damaging the compressor 26.

In the first embodiment shown in FIG. 2, the degree of opening of the expansion valve 18 is controlled thermostatically, as is well known in the art. In one example, a bulb 32 containing refrigerant of the same composition as that in the evaporator 8 is in thermal contact with the outlet 24 of the evaporator 8 and is connected through a capillary tube 33 to the expansion valve 18. A spring-biased movable diaphragm within the expansion valve 18 is subject at one side to the pressure of the refrigerant in the bulb 32 and at the other side to the pressure of refrigerant at the inlet of the evaporator 8. The position of a needle connected to the diaphragm determines the degree of opening of the expansion valve, so that the superheat at the outlet 24 is maintained constant at a predetermined level above zero. This arrangement is shown for example in GB 2302725.

In a second embodiment shown in FIG. 3, the expansion valve 18 is controlled by an electrical signal on a line 20 connected to a controller 22. The degree of opening of the expansion valve 18 is variable, and may be driven by a stepper motor. The controller 22 is preferably a programmable microcontroller with analog inputs and outputs, digital communications inputs and outputs, and memory for storing a program for implementing the algorithms described below and for temporary storage of working variables. The program may be stored on a carrier and loaded into the memory.

In the third embodiment shown in FIG. 4, the expansion valve 18 is controlled by a pulsed electrical signal on a line 20 connected to the controller 22, which switches the expansion valve 18 between the open and the closed position with a duty cycle controlled by the controller 22.

In the second embodiment, a superheat sensor 32 is provided at the outlet 24 of the evaporator 8. The superheat sensor detects the degree of superheat of the refrigerant and outputs an electrical signal on a line 34 to the controller 22, whereby the controller 22 detects whether the degree of superheat is at a predetermined level. The degree of opening, or duty cycle, of the expansion valve 18 is controlled to keep the detected level of superheat close to the predetermined level.

Suitable sensors 32 for detecting superheat are described in more detail in U.S. Pat. No. 5,691,466 and U.S. Pat. No. 5,813,242, which are incorporated herein by reference. The superheat sensor 32 may be sensitive to the degree of superheat, or may only be able to detect when a threshold level of superheat has been reached, for example by detecting the presence of liquid refrigerant. Other methods may be used without departing from the scope of the invention. For example, the outlet pressure and temperature may be detected and may be used to calculate the degree of superheat, or a lookup table may be used to determine which values of pressure and temperature correspond to the predetermined level of superheat.

In the third embodiment, an approximate measure of superheat is derived from the difference between the temperature sensed by a first temperature sensor 35 at the outlet 24 and the temperature sensed by a second temperature sensor 37 at a point along the evaporator 8 upstream of the outlet 24. Provided that the refrigerant is at boiling point at the upstream point and that the pressure at the upstream point does not differ greatly from that at the outlet 24, the temperature difference is approximately equal to the superheat.

Temperature Control

A temperature sensor 28 senses the temperature outside the evaporator 8. For example, as shown in FIG. 1, the temperature sensor 28 may be positioned to sense the external temperature $T_E$ around the evaporator 8, the "air off" temperature $T_1$ of air leaving the duct 10, the "air on" temperature $T_2$ of air entering the inlet 16 or the temperature $T_3$ of the storage area of the cabinet, or a combination of any of these. For example, the temperature sensor 28 may comprise two or more sensor devices arranged to detect temperatures at different locations cooled by the evaporator 8.

In the first embodiment, the control apparatus includes an on/off valve 19, such as a solenoid valve, which has a simple on-off operation to allow or prevent the flow of refrigerant into the evaporator 8. The on/off valve is positioned upstream of the expansion valve 18. The temperature sensor 28 acts as a thermostat controlling the on/off valve 19 directly through an electrical connection 30. For example, the temperature sensor 28 may switch a current through a solenoid of the on/off valve 19. If the sensed temperature rises above a predetermined maximum level, the temperature sensor 28 opens the on/off valve 19. If the sensed temperature falls below a predetermined minimum level, the temperature sensor 28 closes the on/off valve 19.

In the second embodiment, the temperature sensor 28 generates an electrical signal representing the sensed temperature on a line 30, which is input to the controller 22. If multiple temperatures are sensed, the input from each sensor device is input to the controller. The controller 22 compares the temperature or temperatures sensed by the temperature sensor 28 with a desired maximum and minimum temperature range programmed in the controller 22 through a communications interface. The controller 22 controls the state of the on/off valve 19 by an electrical signal on a line 21. If the sensed temperature is above the desired maximum, the on/off valve 19 is opened and refrigerant flows through the expansion valve 18 and through the evaporator 8.

The temperature control arrangement of the third embodiment differs from that of the second embodiment in that the on/off valve 19 is not present. Instead, the controller 22 maintains the pulsed expansion valve 18 closed if the sensed temperature is below the desired minimum and reverts to the pulsed operation of the expansion valve when the sensed temperature rises above the desired maximum.

In each embodiment, the expansion valve 18 is controlled, as described above, to keep the superheat at the outlet 24 of the evaporator 8 constant unless overridden by the temperature control process. If the temperature sensed by the temperature sensor 28 is below the desired minimum temperature, no refrigerant flows through the evaporator 8 and the superheat at the outlet 24 is not controlled. The sensed temperature will then rise until it exceeds the desired maximum temperature, whereupon the flow of refrigerant recommences and is controlled to keep the superheat constant at the outlet 24.

Defrost Control Algorithm

The temperature and superheat control systems described above are, in themselves, easy to implement and commonly found in heat transfer systems. A novel defrost control algorithm, which can be used in conjunction with conventional superheat control systems, will now be described.

In the first and second embodiments, a flow meter 25 is positioned in the refrigeration circuit and outputs signals representing the flow rate of refrigerant through the circuit on a line 27 connected to the controller 22. The flow meter 25 is connected between the condenser and the on/off valve 19 in the first embodiment, and between the on/off valve 19 and the expansion valve 18 in the second embodiment, so as to measure the flow of liquid refrigerant at high pressure. However, this type of flow meter may be positioned anywhere in the high pressure side of the refrigeration circuit.

Alternatively the flow meter 25 may be designed to measure the flow of refrigerant gas and is then positioned anywhere in the low pressure side of the circuit. The flow meter may be of the type having a propeller, positioned in the fluid flow, connected to a generator or position detector which outputs a signal indicating the flow rate.

As an alternative to the flow meter 25 in the first and second embodiments, a sensor may be used to detect the degree of opening of the expansion valve 18, which is taken as an approximate measurement of flow, or is converted to an approximate flow rate using a look-up table.

In the third embodiment, the flow meter 25 is not present. Instead, the duty ratio of the pulsed expansion valve 18 is taken as representing the rate of flow. Since the pressure drop across the expansion valve 18 does not vary greatly, the duty ratio is a sufficiently good indicator of flow rate for the purposes of the defrost control algorithm. Alternatively, the flow meter 25 may be present in the third embodiment so that the rate of flow is measured directly rather than derived from other measurements. The measured flow rate is integrated over one or more duty cycles of the pulsed expansion valve 18.

Figure 5:
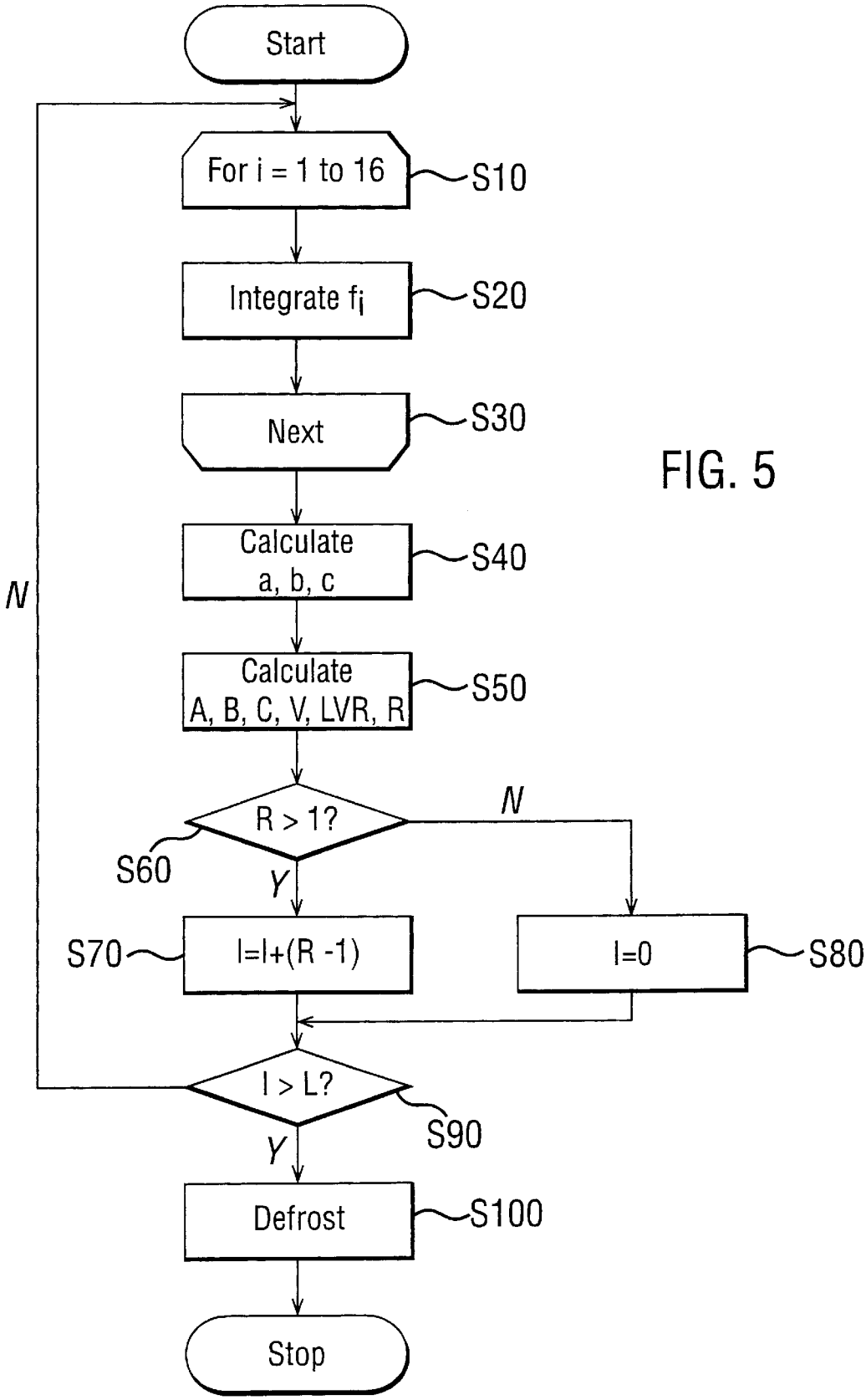
FIG. 5 is a flow chart of a defrost control algorithm performed by the controller in each of the embodiments.

The defrost algorithm will now be described with reference to FIG. 5. The algorithm starts once a defrost operation has been completed and a short period, such as 30 seconds, after the temperature control process permits the flow of refrigerant through the evaporator 8. In the first embodiment, the controller 22 may detect the state of the on/off valve 19 indirectly by detecting whether any flow is measured by the flow meter 25. In the second embodiment, the controller 22 controls the on/off valve 19, while in the third embodiment the controller 22 determines whether to pulse or maintain closed the expansion valve 18. In both the second and third embodiments, the controller 22 performs the temperature control process and determines internally whether the flow is switched on or off.

In steps S10 to S30 the controller 22 measures the flow rate F and integrates the measured value over each completed minute to give a total flow $f_i$, where i is incremented from one to 16. If the temperature control process interrupts the flow of refrigerant, the integrated value for the current minute is stored and the integration continues a short period, such as 30 seconds, after the flow of refrigerant resumes, until a total integration period of one minute is complete.

At step S40, when integrated flow values $f_i$ have been measured from 1 to 16, the controller 22 calculates the highest value but one a, the lowest value but one b, and the mean value c. At step S50, the means of the last four calculated values of each of a, b and c are calculated as A, B and C respectively. A volatility value V is calculated according to the following equation:

$$V = \frac{(A - B)}{C} \tag{1}$$

The mean of the volatility V since the last defrost until the present is calculated as the long-range volatility LRV. The ratio of V to LRV is calculated as R. A variable I is initially set to zero. When R is greater than 1 (step S60), the variable I is incremented by the amount by which R exceeds 1 (step S70 ). When R is less than or equal to 1, I is reset to zero (S80). When I reaches a predetermined level L (S90), the controller 22 initiates a defrost operation (S100). The algorithm repeats only after the defrost has actually been performed.

The value of the predetermined level L is preferably adjustable by an operator, to customise the defrost controller for a specific set of operating conditions. For this purpose, the controller 22 includes a communications interface which allows parameters to be set by a local or remote operator.

The value of the predetermined level L may be automatically varied by the controller 22 as a function of the cost of fuel used for defrosting at the current time of day. For example, electricity may be charged at a cheap night rate during defined night hours and a more expensive day rate during defined day hours. The controller may select a first, lower value of L during the defined night hours and a second, higher value of L during the defined day hours, so as preferentially to initiate a defrost during night hours while still allowing a defrost during the day if necessary.

Figure 6:
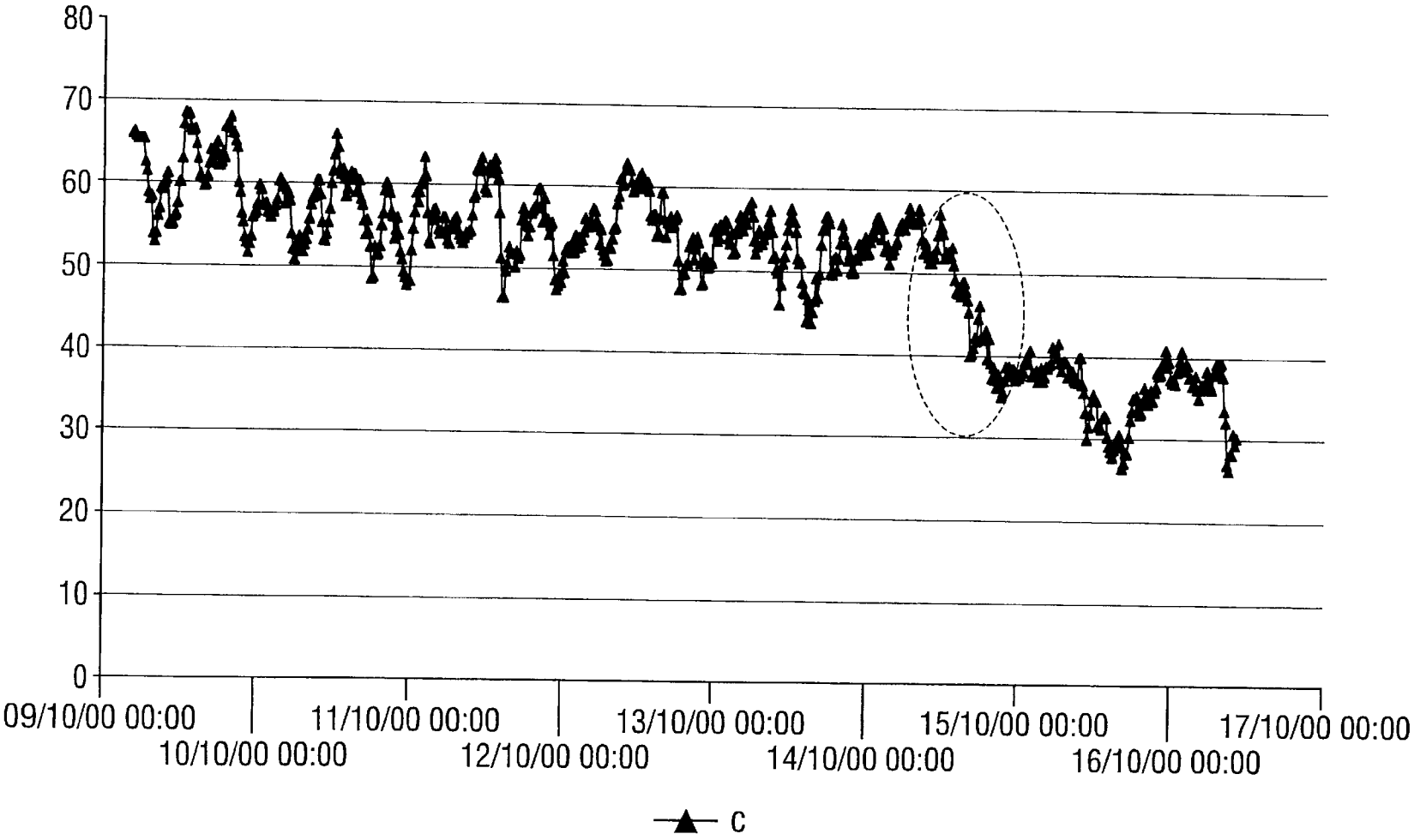
FIG. 6 is a graph of the mean refrigerant flow in a refrigeration system in an experimental example.
Figure 7:
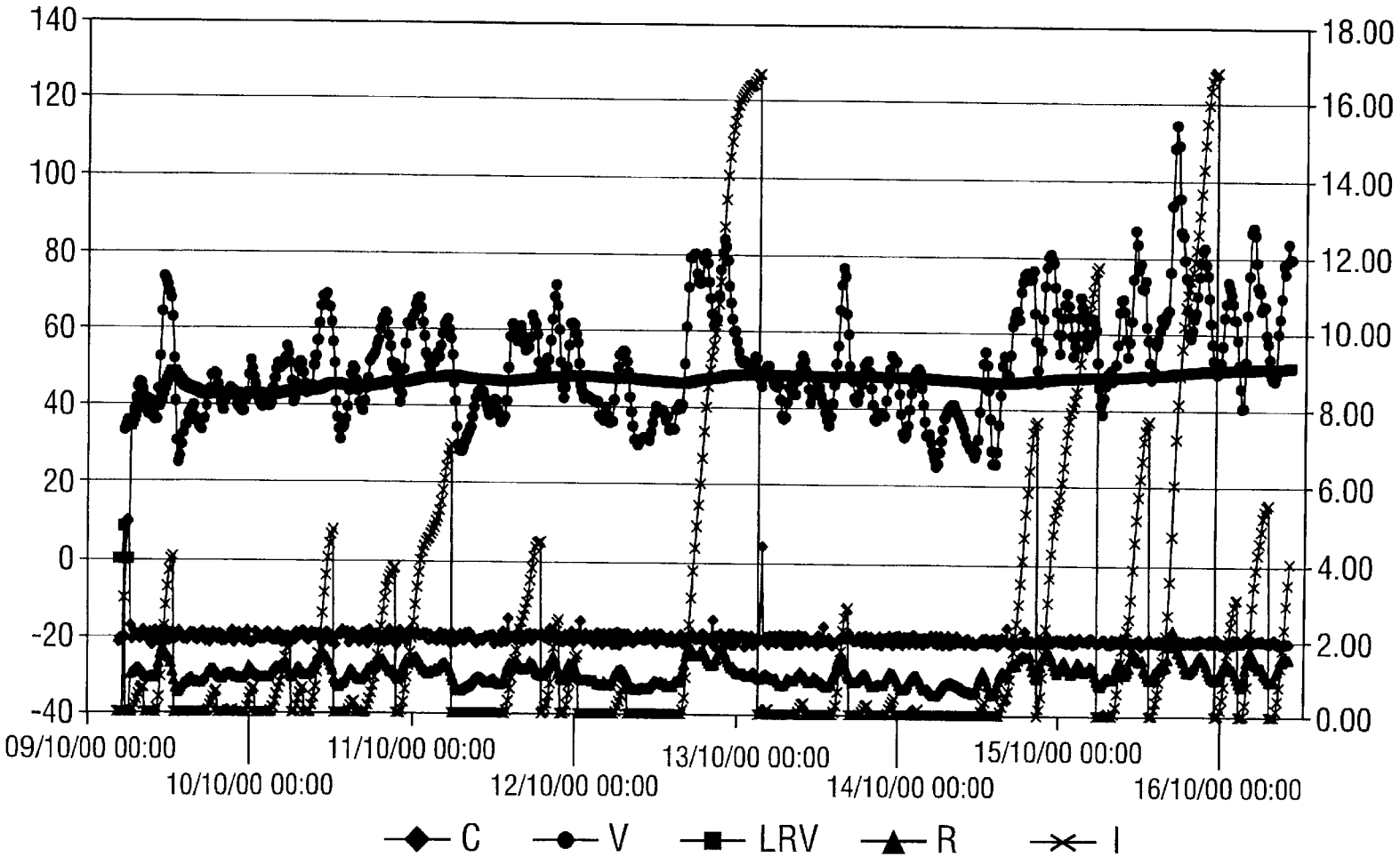
FIG. 7 is a graph of the further parameters relating to the variation of flow in the experimental example.

In a specific example run over a period of approximately 174 hours, the mean value c is plotted in the graph of FIG. 6, while the values of V, LRV, R and I are plotted in the graph of FIG. 7, together with cabinet temperature C. In this example, the defrost was not initiated, to illustrate the effect of progressive frosting of the evaporator. Appropriate values of L can de deduced from the graphs; in the example illustrated in Table 1 below, L is set at 8 during the day and at either 6 or 8 during the night. The result of the defrost algorithm is illustrated for a maximum time before defrost of 48 hours and 72 hours, and for no maximum time between defrosts. For each of these settings, the date and time of defrost is marked with an 'X'.

TABLE 1

| | | | Defrost Events | | | | | | |
|---|---|---|---|---|---|---|---|---|---|
| | | | Elapsed | | Max 48 Hours | | Max 72 Hours | | No Max |
| Date | Time | Event | Time | I | 8/6 | 8/8 | 8/6 | 8/8 | 8/8 |
| 9 Oct | 05:17 | Start | 0:00 | 0.00 | | | | | |
| 9 Oct | 13:17 | Min time | 8:00 | 0.00 | | | | | |
| 11 Oct | 04:32 | Defrost required | 47:15 | 6.10 | X | | X | | |
| 11 Oct | 05:17 | Max Time | 48:00 | 6.87 | | X | | | |
| 12 Oct | 05:17 | Max Time | 72:00 | 0.00 | | | | X | |
| 12 Oct | 19:17 | Defrost required | 86:00 | 8.01 | | | | | X |

As can be seen from FIG. 6, the mean flow c through the evaporator steadily decreases after a defrost until a point (circled on the chart, in the afternoon of October 14) is reached at which the mean flow c declines sharply. At this point, the superheat control algorithm has become unstable; it is important that a defrost be performed before this occurs. Even in the case where there is no maximum time between defrosts, the defrost control algorithm would have initiated a defrost well before this time.

It is believed that the flow through the evaporator becomes unstable as the evaporator frosts up because of overshoot in the superheat control. Frost building up on the evaporator reduces the ability of the evaporator to extract heat from the thermal load, and the superheat at the outlet falls below the desired level. In response, the superheat control decreases the flow of refrigerant, but this causes the superheat to rise rapidly because of the thermal insulation between the evaporator and the thermal load. Hence, the insulating effect of the frost causes the level of superheat to respond more quickly to the variation in flow rate, which leads to overshoot. However, the invention is not limited to this effect, and other effects may additionally or alternatively be responsible for the instability of flow as the evaporator frosts up.

Since the variation in flow is caused by a variation in superheat at the outlet, the superheat may instead be measured by the defrost controller 22 and used as the input parameter of the defrost control algorithm. Any of the methods for measuring superheat as described above may be used for this purpose. For example, a superheat sensor may be used, or an approximate superheat measurement may be taken by measuring the difference in temperature between the outlet and a point along the evaporator upstream of the outlet.

Defrost Operation

In each of the illustrated embodiments, a defrost heater 36 is arranged around the evaporator 8 and can be electrically heated so as to defrost the evaporator 8. The defrost heater 36 is switched on and off under the control of an electrical signal on a line 38 from the controller 22.

When the controller 22 determines that the evaporator 8 should be defrosted, it switches on the defrost heater 36. In the first and second embodiments, the controller 22 closes the on/off valve 19 for the duration of the defrost cycle. For this purpose in the first embodiment, the controller 22 is connected to the on/off valve 19 by a line 21, so that the controller 22 can override the temperature sensor 28 to close the on/off valve 19. In the third embodiment, the pulsed expansion valve 18 is held closed (zero duty ratio).

As an alternative to electrical defrosting, the air or gas methods, or other methods of defrosting an evaporator, may be used under the control of the controller 22.

If less than a predetermined minimum time, such as eight hours, has elapsed since the last defrost, the controller 22 does not initiate a defrost, but continues to run the defrost algorithm. A defrost is initiated only when the value of I reaches the level L after the minimum time has elapsed.

A defrost may automatically be initiated if more than a maximum period, such as 2 or 3 days, has elapsed since the last defrost, since there is little incremental gain in defrosting at intervals greater than this maximum period.

In one example, in which the refrigerated display cabinet 2 is a stand-alone cabinet, the controller 22 begins the defrost cycle immediately on initiation of defrost.

Alternatively, the cabinet 2 may be one of an array of refrigerated cabinets, such as is used in a supermarket. In that case, there is a maximum number of display cabinets which can be defrosted at any one time, in order to limit the load on the defrosting system. The defrosting of cabinets is therefore coordinated to avoid exceeding this maximum number.

If a gas defrost method is used, the hot or cool gas may be distributed from a central plant room to the evaporators of the cabinets to be defrosted. The controller 22 is connected through a communications network to a remote defrost controller located in the plant room. The remote defrost controller controls the opening and closing of valves to direct the hot or cool gas to the evaporators selected for defrosting.

When a defrost is initiated for a specific refrigerated cabinet 2, the controller 22 sends a signal to the remote defrost controller, which adds data representing the refrigerated cabinet 2 to a defrost queue. The remote defrost controller defrosts the cabinets in the order of the queue. In such a system, a delay is incurred between entering the cabinet on the defrost queue and defrosting of the evaporator 8. However, the level L is chosen so as to cause initiation of a defrost a considerable time before the defrost becomes essential.

Alternatively, the hot or cool gas can be supplied through a ring main, separately from the normal supply of refrigerant. When the controller 22 initiates defrost, it opens a valve to connect the evaporator 8 to the ring main. The controller 22 of each display cabinet may be connected to a communications network so as to co-ordinate defrosting to avoid exceeding the maximum number of cabinets which are defrosted at any one time. In this case, the controller may initiate defrosting by sending a defrost request signal over the network and open the valve in response to a defrost control signal from the network.

To reduce the temperature shock and energy consumption caused by a defrost cycle, the defrost cycle should stop as soon as possible after all the ice on the evaporator 8 has melted. The temperature $T_E$ in the vicinity of the evaporator 8 is measured by the controller 22 and the defrost cycle is stopped when the temperature rises above a predetermined level, such as 15° C. If the temperature has not risen above this level after a predetermined period, then the defrost cycle is stopped.

Alternatively, the evaporator 8 may be isolated from the rest of the system and the pressure within the evaporator is measured. Provided the evaporator contains a mixture of liquid and gaseous refrigerant, the vapour pressure inside the evaporator 8 is used to determine the temperature of the evaporator. When this temperature has risen above a predetermined level, the defrost cycle is stopped. Alternatively, the defrost period is determined by a timer set so as to ensure that all the frost has melted, without causing too great a temperature shock.

Since the defrost cycle is only activated for a short time, the temperature of the cabinet contents does not rise sufficiently to cause spoiling of perishable goods.

Alternative embodiments

In the above embodiments, the flow of refrigerant through the evaporator is switched on and off to achieve the required temperature range of the thermal load. Alternatively, refrigerant may flow continuously through the evaporator, regulated by the expansion valve 18 to maintain the predetermined level of superheat at the outlet, to provide continuous cooling. Temperature control may then be achieved by switching on and off the flow of refrigerant through further evaporators which cool the same thermal load.

Alternatively, where precise temperature control is not required, the refrigeration cycle may be run continuously so that an equilibrium temperature is reached between the thermal load and the surroundings. The equilibrium temperature may fluctuate to some degree as the evaporator frosts up, which will also affect the flow rate of refrigerant needed to achieve the predetermined level of superheat at the outlet. The value of L is chosen to take account of this effect.

Although the above embodiments have been described with reference to a refrigerated display cabinet, it will be appreciated that the present invention is also applicable to any heat transfer system in which frequent defrosting of an evaporator 8 is required. For example, the present invention is also applicable to freezer display cabinets, cold rooms, blast chillers, blast freezers, air conditioners or heat pumps in which heat is extracted from ambient air or water in a heating system. In the case of heat pumps, the temperature of the thermal load which is warmed by the condenser may be sensed by the temperature sensor 28 and used to switch on and off the flow of refrigerant through the evaporator.

What is claimed is:

1. Apparatus for controlling defrosting of an evaporator in a heat transfer system, including a defrost controller arranged to detect variation in a flow of refrigerant through the evaporator while the superheat at an outlet of the evaporator is maintained substantially at a predetermined level, to calculate a volatility of the flow as the variation over a period and to initiate defrosting of the evaporator on the basis of said calculated volatility.

2. Apparatus as claimed in claim 1, including a flow sensor arranged to sense the flow of refrigerant through the evaporator, wherein the defrost controller is arranged to detect said variation in the flow by means of said flow sensor.

3. Apparatus as claimed in claim 1, including a superheat sensor arranged to detect the degree of superheat of refrigerant at the outlet of the evaporator, wherein the defrost controller is arranged to detect said variation in the flow by means of said superheat sensor.

4. Apparatus as claimed in claim 1, wherein the heat transfer system includes a valve arranged to regulate the flow of refrigerant through the evaporator, the defrost controller being arranged to detect said variation in the flow by detecting the state of the valve.

5. Apparatus according to claim 1, including a first temperature sensor arranged to detect a first temperature of the refrigerant at the outlet and a second temperature sensor arranged to detect a second temperature of the refrigerant in the evaporator substantially upstream of the outlet, wherein the defrost controller is arranged to detect said variation in the flow as a function of the difference between the first and second temperatures.

6. Apparatus according to claim 1, wherein the defrost controller is arranged to calculate a long-term average value of said volatility and to determine whether to initiate defrosting on the basis of said long-term average value and said calculated volatility.

7. Apparatus according to claim 6, wherein said long-term value is calculated as the average value of said volatility since a preceding defrost.

8. Apparatus according to claim 6, wherein the defrost controller is arranged to calculate the ratio of said calculated volatility and said long-term volatility, and to determine whether to initiate defrosting on the basis of said ratio.

9. Apparatus according to claim 8, wherein the defrost controller is arranged to accumulate successive values by which the value of said ratio exceeds one, and to initiate defrosting if said accumulated successive values exceed a predetermined threshold.

10. Apparatus according to claim 9, wherein said predetermined threshold is variable.

11. Apparatus according to claim 10, wherein said predetermined threshold is variable as a function of time of day.

12. Apparatus a claimed in claim 1, wherein the flow of refrigerant through the evaporator is selectively inhibited and allowed and the defrost controller is responsive to the flow of refrigerant detected while the flow of refrigerant is allowed through the evaporator.

13. Apparatus as claimed in claim 12, wherein the flow switch is responsive to the one or more temperature sensors to inhibit the flow of refrigerant when a minimum temperature condition is reached and to allow the flow of refrigerant when a maximum temperature condition is reached.

14. Apparatus as claimed in claim 1, wherein the evaporator is arranged to extract heat from a display cabinet.

15. A display cabinet including apparatus as claimed in claim 14.

16. Apparatus as claimed in claim 1, wherein the evaporator is arranged to extract heat from a cold room.

17. A cold room including apparatus as claimed in claim 16.

18. A method of controlling defrosting of an evaporator in a heat transfer system, including detecting variation in the flow of refrigerant through the evaporator while the superheat at an outlet of the evaporator is maintained substantially at a predetermined level, calculating a volatility of the flow as the variation of the flow over a period and initiating defrosting of the evaporator on the basis of the calculated volatility.

19. A method according to claim 18, wherein said variation in the flow is detected by means of a flow sensor.

20. A method according to claim 18, wherein said variation in the flow is detected by means of a superheat sensor.

21. A method according to claim 18, wherein said variation in the flow is detected as a function of the difference in temperature between the outlet of the evaporator and a point along the evaporator substantially upstream of the outlet.

22. A method according to claim 18, including calculating a long-term average value of said volatility and determining whether to initiate defrosting on the basis of said long-term average value and said calculated volatility.

23. A method according to claim 22, wherein said long-term value is calculated as the average value of said volatility since a preceding defrost.

24. A method according to claim 22, including calculating the ratio of said calculated volatility and said long-term volatility, and determining whether to initiate defrosting on the basis of said ratio.

25. A method according to claim 24, including accumulating successive values by which the value of said ratio exceeds one, and initiating defrosting if said accumulated successive values exceed a predetermined threshold.

26. A method according to claim 25, wherein said predetermined threshold is variable.

27. A method according to claim 26, wherein said predetermined threshold is variable as a function of time of day.

28. A carrier bearing a sequence of electronically encoded and readable instructions to perform the method of claim 18 when executed by a defrost controller in said heat transfer system.

29. A computer program arranged to perform the method of claim 18 when executed by a defrost controller in said heat transfer system.

* * * * *